United States Patent [19]

Sommer et al.

[11] 4,173,873

[45] Nov. 13, 1979

[54] APPARATUS ON A TEXTILE MACHINE FOR FEEDING YARN, SLIVER OR FIBROUS MATERIALS

[75] Inventors: Werner Sommer, Esslingen; Antonius Vinnemann, Stuttgart; Manfred Walter, Grötzingen; Willi Gaiser, Gäufelden; Heinrich Elsässer, Stuttgart; Wolfgang Brenner, Schlierbach; Hermann Kress, Filderstadt, all of Fed. Rep. of Germany

[73] Assignee: Sulzer Morat GmbH, Filderstadt, Fed. Rep. of Germany

[21] Appl. No.: 869,790

[22] Filed: Jan. 16, 1978

[30] Foreign Application Priority Data

Jan. 17, 1977 [DE] Fed. Rep. of Germany ..... 2701652
Nov. 10, 1977 [DE] Fed. Rep. of Germany ..... 2750192

[51] Int. Cl.[2] ..... D04B 3/06; D04B 15/48; D04B 27/10; D04B 35/00

[52] U.S. Cl. ..... 66/125 R; 66/132 R

[58] Field of Search ..... 66/84 A, 125, 64, 126, 66/132, 62, 60; 139/436, 224; 28/101, 102

[56] References Cited

U.S. PATENT DOCUMENTS

| | | | |
|---|---|---|---|
| 284,905 | 9/1883 | Salisbury | 66/62 |
| 528,810 | 11/1894 | Salisbury | 66/62 |
| 559,850 | 5/1896 | Johanson | 66/62 |
| 2,821,073 | 1/1958 | Mehnert | 66/64 |
| 3,446,038 | 5/1969 | Inui | 66/84 A X |
| 3,593,394 | 7/1971 | Bolles | 66/84 A |
| 3,703,818 | 11/1972 | Umeda et al. | 66/125 |
| 3,707,083 | 12/1972 | Svoboda | 66/125 |
| 3,732,896 | 5/1973 | Jekl et al. | 139/224 X |
| 3,751,944 | 8/1973 | Krause | 66/64 |
| 4,034,783 | 7/1977 | Pech et al. | 139/436 |
| 4,081,001 | 3/1978 | Borodin et al. | 139/436 |

*Primary Examiner*—Ronald Feldbaum

[57] ABSTRACT

An apparatus for feeding yarn, or the like vice yarn guides which travel on an endless O-shaped floating-mounted track to present the yarn, or the like to the instrumentalities of a textile machine.

32 Claims, 10 Drawing Figures

APPARATUS ON A TEXTILE MACHINE FOR FEEDING YARN, SLIVER OR FIBROUS MATERIALS

The invention relates to an apparatus for textile machines for feeding yarn, sliver or fibrous materials, wound on to fixed supply packages, with at least one endless track, having a working section and a return section, the said track having movable material transporting elements arranged on it to run around in series.

Certain textile machines, e.g. flat bed knitting machines with carriages running around an endless track (Dt. OLS No. 15 85 454), circular knitting machines with rotating cam boxes (Dt.OLS No. 25 40 498), warp-knitting machines or undulating shed weaving machines (Dt.OLS No. 24 50 020) embody endless circulating tracks for a number of yarn feeders. To avoid that the numerous yarns become entangled or entwined with each other due to the constant rotational movement of the yarn feeders, each feeder is fitted on a frame, which also carries a supply package, a yarn eyelet, a nipping mechanism and where necessary, also a cutting device, so that several units, comprising each of a yarn feeder, a yarn eyelet, a supply package, a nipping device and a cutting device, must revolve behind each other on a common endless track.

One disadvantage of such a yarn feeder is that only relatively few of the said units can be fitted on the textile machine, since otherwise, there would be insufficient space for many supply packages and moreover, the weight to be transported would be too great. Another disadvantage is seen in that empty supply packages can be changed only when the textile machine is stopped. This means a significant reduction in production capacity.

Apparatus of the abovementioned type are known (Dt. OLS No. 20 64 227 and Dt.OLS No. 23 51 741), incorporating stationary supply packages for the yarns supplied to a knitting, warp knitting or weaving machine. To avoid entanglement of the yarns, an endless figure of eight track is provided for the yarn feeders, nipping devices and yarn guides, as the result of which, the yarns, during the rotation of the yarn guides, entwine in one part of the eight in the one direction and during the yarn guide movement in the other part of the eight, entwine in the opposite direction, so that after every complete rotation of all yarn guides, the desired starting position is re-established and entanglement cannot occur.

A disadvantage of such a design of rotary track is the situation that the yarn sections between the yarn feeders and the eyelet support are so severely entwined, particularly at the moment when the yarns are being processed into stitches, or for some other reason are being withdrawn from the supply package, that they make contact with each other and hence rub together, because only those feeders of the yarns, whose yarn guides pass through the middle section of the track are located in their working region and can therefore be used for feeding the yarns into the machine. The consequence of this is that different yarn tensions arise and even damage to the yarns may occur during their take-off from the supply packages, and thus must be avoided. For example, if the said yarn sections are arranged essentially mutually parallel on the mid section of their figure of eight track, and are therefore not entwisted, then these yarn sections will be entwisted by 180° when passing through one outer section, by 360° when repassing through the mid section, by 180° when passing through the other outer section, and by 0° when next passing through the mid section, etc., so that during every second passage of the mid section, there is a 360° entwining, which when using a large number of yarns means a thick knot of threads which does not allow the withdrawal of yarn from the supply packages. Correspondingly, entwining of alternately +180° and −180° or +270° and −90° or the like would be conceivable in the mid section of the figure of eight track, and this too would be impractical. It is also conceivable that one of the two outer sections of the 8-track for the yarn feeders to be arranged in the direct vicinity of the working region, because it is possible that there would be 0° entwining at an outer section with every passage of the yarn guide. However, such an arrangement is not feasible in practice, because the yarn guides, during each circuit of the 8-track cross their own paths once and can therefore be located on only one half of the track, which means that there are no yarn guides on each outer section during half the time of each track circuit and the textile machine to be supplied with yarns will be unable to work for a corresponding period of time.

The described contacting of the yarns can also not be prevented by providing swiveling eyelet supports as with known yarn guides. Apart from the fact that the yarn eyelets have to be moved to and fro along an extremely complicated curve, due simply to the presence of a large number of yarns, it is also inconceivable that a movement of the yarn eyelets would be adequate with any number of threads, to prevent mutual contacting of the yarns during their feeding to the machine.

In the case of a flat bed knitting machine, the figure of 8 track of the known yarn feeding arrangement must also be arranged in the direct vicinity of the machine, i.e. in a horizontal plane, close above the knitting needles, since otherwise, the nipped yarn ends would have to be relatively long and consequently, could no longer be presented reliably to the needles.

This leads to further disadvantages, namely that the spools above the needle beds is no longer accessible, thus making it very difficult to work on the machine.

Corresponding disadvantages result from using the known method of yarn feeding on circular knitting machines and other stitchforming machines, warp-knitting machines and weaving machines or other yarn, sliver or fibrillar materials, e.g. glass fibres, metal wires or the like.

The aim of the invention is therefore to improve on the abovedescribed apparatus in that the materials are withdrawn from the supply packages only when there is a slight degree of entwining amongst them and they are not in mutual contact, but this is done without the need to stop the textile machine. Moreover, the yarn feed system is constructed such that it takes up the smallest possible space in the direct vicinity of the textile machine and offers the least possible hindrance to working on the machine.

These objectives are achieved by the characteristic features wherein the track is a single-path, O-shaped, floating-mounted track and the materials are fed to the movable elements during their successive runs through the working section alternately from the one and the other side of a surface, laid through the working section and the return section of the track.

The invention is based on the knowledge that as the result of the alternating feed of materials from the one and other side of the said surface, both the entwining and the figure of 8 track for the material feeders can be avoided.

The invention offers the advantage that when using a large number of feeder elements and a stationary eyelet support, the materials cannot contact each other while they are being withdrawn from the supply packages and are fed to the textile machine. Another advantage is that a compact, space-saving apparatus can be designed which takes up little space, especially in the vicinity of the working region to be held free for working on the textile machine. Finally, the O-shaped, single-track is extremely reliable to operate and is cheap because, for the feeding of the material sections between the eyelets and the guide elements, provision can be made for stationary guide rail systems or simple pivot levers attached to the material feeders.

The apparatus according to the invention can be used to particular advantage on knitting machines according to Dt.OLS No. 25 31 762.

Further advantageous features of the invention are characterised in the sub claims.

Figure 1:
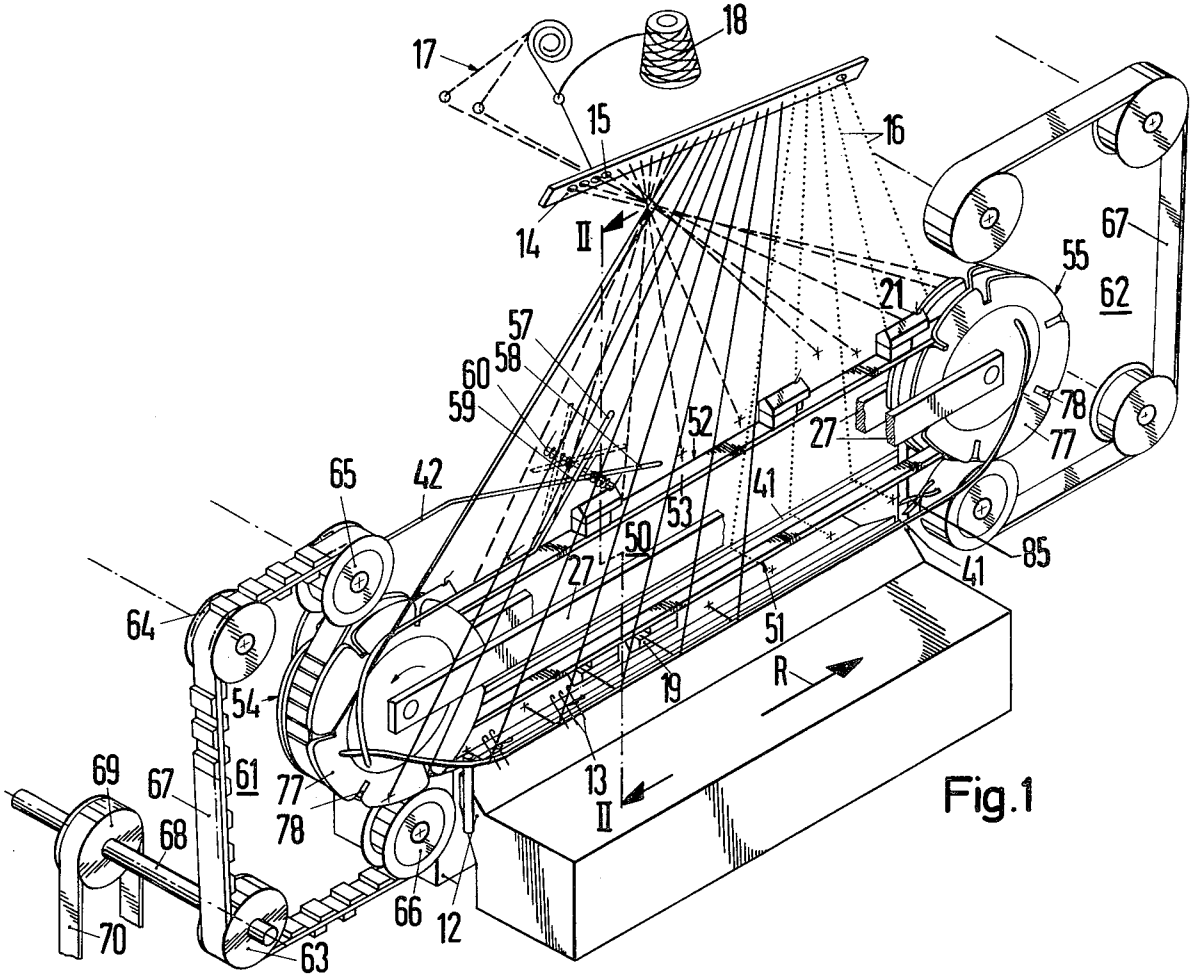
FIG. 1 shows a schematic perspective view of an apparatus according to the invention.
Figure 2:
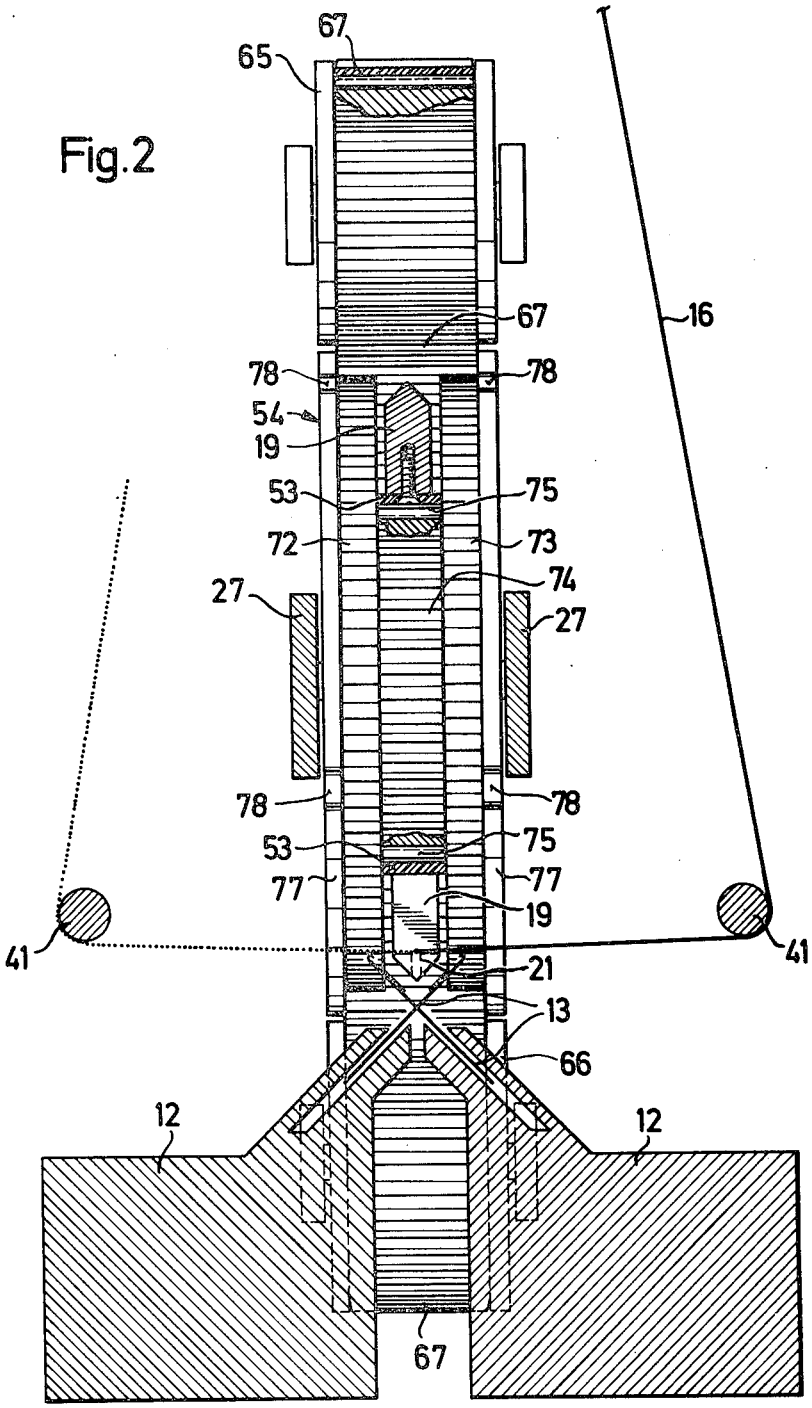
FIG. 2 shows a section along the line II—II of FIG. 1.
Figure 3:
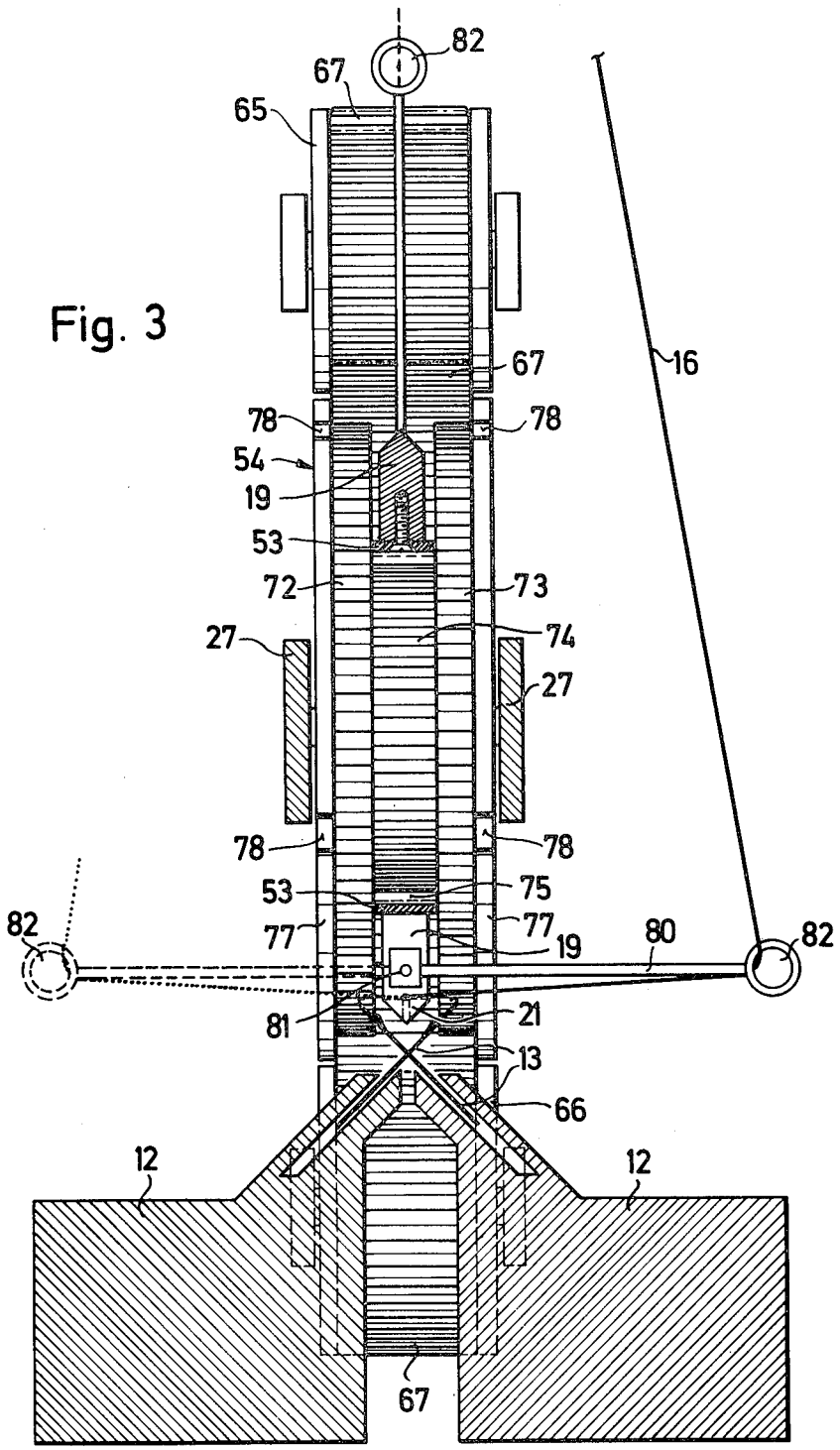
FIG. 3 shows a section, corresponding to FIG. 2, indicating an alternative method of deflecting the yarns.

FIGS. 1 to 3 show an apparatus according to the invention for feeding yarn in conjunction with a known flat bed knitting machine (Dt. OLS No. 25 31 762), having a frame with two needle beds 12 arranged in V-shape. In the tricks of these needle beds, knitting needles 13, preferably latch needles, can travel in known manner. If all the needles are in the advanced position, they (13) define a working region running parallel to the needle beds 12, arranged close above the cross formed by the knitting needles 13, and along this working region, the yarn feeding elements have to be traversed, such that the yarns are gripped by the knitting needles 13 and processed into stitches. Further details of the flat knitting machine, not necessary for the understanding of the invention, can be obtained from Dt. OLS No. 25 31 762.

Above the machine, provision is made for a stationary eyelet support 14, arranged preferably parallel to the working range of the thread-laying elements. Through these eyelets 15, several yarn, sliver or fibrillar materials, e.g. threads 16, can be fed from stationary supply packages 18 (not illustrated) to a plurality of guide elements in the form of thread guides 19, with laying-in elements in the form of thread eyelets 21 and above the eyelet support 14, a storage device 17 for each thread 16 is indicated, which during the return movement of the yarn guide 19 serves to provisionally store the resulting released yarn section and avoids a loose sagging of the yarn.

An endless circular track 50 is provided for the transport of the yarn guides 19, said track having a working section 51, a return section 52 and two sections connecting these, such that the working section 51 lies above the working range of the yarn-laying-in elements 21. The return track section 52 is located between the working section 51 and the eyelet support 14. The rotary track 50 is formed by an endless, flexible belt 53 on which the yarn guides 19 are attached and demarcated by two deflector wheels 54, 55, the axes of which are mounted at the ends of the rigid rail 27. To ensure that the yarns 16 are arranged alternately on the one and on the other broad side of the rotary track 50 during the repeated rotation of the yarn guides 19 in the direction of the arrow R, guides are provided, incorporating two guide rails 57 and 58, forming an entry funnel, and a shunt 59, which in any known manner, e.g. with two electro-magnets 60, (joined together by a cable, not illustrated, with a control mechanism) can be switched from the position indicated by a full line in FIG. 1, into the dotted line position, and vice versa, and thus serves to deflect the yarns 16 alternately to the one or other side of the rotary track. The shunt 59 has two guide rails 42 connected to it and these take over the yarn 16, deflected by the shunt 59 to the one or other broad side of the track 50, and transfer the said yarns 16 to the guide rail 41, so as to ensure that the yarns cannot come into contact with any parts of the yarn feeding system or with the knitting machine.

The deflector wheels 54 and 55 cannot be rigidly mounted, i.e. with a support frame engaging their axes or shafts, because the support frame in this case, would make it impossible to deflect the yarns to at least one side of the track 50. However, in order to still make some form of bearing possible, according to the invention, on the two ends of the track 50, provision is made for a support construction 61 and 62 for a floating support of the track 50, acting on the outer perimeter of the deflector wheels 54 and 55. Each support construction 61, 62 comprises four support rolls 63,64,65,66, mounted rotatably in a frame (not illustrated) outside the track 50. The support construction 61 also serves as the drive for the belt 53 carrying the yarn guides 19. For this purpose, a support apron 67 is wrapped around the support rolls 63 to 66, this apron 67 lying against the perimeter of the deflector wheel 54 (and 55) so as to support and drive same. On its outer and inner side, the support apron 67 is preferably toothed, the teeth engaging in corresponding toothing on the outside perimeter of the support rolls 63 to 66 and on the deflector wheels 54, 55, making slippage by the support apron 67 impossible. The support roll 63 is connected with a drive, having another wheel 69, attached to the shaft 68 of the support roll 63, said wheel 69 being coupled to the drive pulley of a drive motor by means of a belt 70 or the like.

The design of the deflector rolls 54,55, is illustrated in a sketch in FIG. 2. Each deflector wheel consists of two circular discs 72, 73, with a support belt 67 resting against their perimeter and between said discs 72,73, a coaxial drive wheel 74 for the yarn guides 19 is attached; the belt 53 runs around said drive wheel 74. The outer perimeter of the drive wheel 74 and the inside of the belt 53 may be suitably toothed 75 to prevent slippage of the belt 53. The outside diameter of the drive wheel 74 is smaller than the outside diameter of the circular discs 72, 73, by an amount such that the yarn guides 19 can be accommodated completely when passing the deflector wheels 54 and 55, according to FIG. 2, in the space between the peripheral lines of the circular discs 72 and 73 and the drive wheels 74.

To avoid damage to the yarns 16, after they have been deflected by the shunt 59 to the one or other side of the track 50 and are transferred to the guide rails 42 and 41, while the relevant yarn guides 19 pass the deflector wheels 54 and 55, radial slots can be provided in the outer circumference of the circular discs 72 and 73. Corresponding radial slots 78 (FIG. 1) are provided in the flanged discs 77, which are attached coaxially to the two outer sides of the circular discs 72 and 73, and have a somewhat larger diameter than these, in order to prevent the support belt 67 slipping off.

The operation of the yarn feeding system according to FIGS. 1 and 2 is as follows: During repeated rotation of the yarn guides 19, which may be arranged over the whole length of the track 50, each yarn 16, after completing one cycle of the belt 53, reaches the shunt 59 once, and from this shunt, the yarn is deflected alternately to the one or other side of the track 50. In addition, all yarns 16, once the relevant yarn guides 19 reach the right hand side of the working section 51 in FIG. 1, are cut by means of a cutting device 85, and the resulting thread ends are held by yarn clamps (not illustrated) provided in the yarn guides 19, until the yarn guides again reach the left hand start of the working section 51 (FIG. 1) and the yarns 16 are released again.

For simplicity, in FIG. 1, all the yarns which are deflected to the front broad side of the track 50 in FIG. 1 are depicted by a full line, while the yarns deflected to the other (rear) broad side of the track 50 (FIG. 1) are depicted by a dotted line and the not deflected yarns are shown by a broken line. Due to the fact that in FIG. 1, a section of the rail 27 is broken off, the rear guide rail 41 is partially visible. It can be seen from FIG. 1 therefore, that up to the indicated point of time, the yarn-laying elements 21 of the two last dotted yarns and the first five full-line yarns 16 are located in the working region, whereas the relevant yarn guides 19 pass through the working section 51, and the dotted-line yarns are fed from the rear broad side and the full-line yarns are fed from the front broad side of the track 50. To ensure that the knitting process takes place quasicontinuously, i.e. corresponding to the small interval between the yarn guides 19 in the working section 51, a total of 23 yarns is required, of which knitting can be carried out simultaneously at any time with seven yarns. Although the yarn guides 19 and the yarn-laying-in elements 21 run around a circular track, the yarn sections between them and the eyelets 5 cannot become entwined, because the return section 52 lies between the working section and the eyelet support 14, and hence the return of the cut yarn ends takes place through the space which is demarcated roughly by the working region of the laying-in elements 21, the eyelets 15 and the guide rails 41 and 42 or by those surfaces, which are passed through by the yarns 16 being deflected towards the broad sides of the track 50.

In the embodiment according to FIG. 1, the guide rails 41 and 42 may be omitted if yarn guides 19 with rocking pivoting levers 80 are used as in FIG. 3. According to FIG. 3, which corresponds to FIG. 2 in all essential details, the rocking levers 80 are connected by means of swivel pins 81 with the yarn guides 19 and provided at their free ends, each with an eyelet 82 for guiding the yarn 16. When the yarn guides 19, according to FIG. 3 are on the upper track of the belt 53, the rocking levers 80 assume a vertical position so that they, instead of the yarn 6, enter the intake funnel formed by the guide rails 57 and 58, and are then deflected by the shunt 59 to the one or other side to such an extent that the yarn sections, located between the yarn guides 19 and the eyelets 15 are deflected alternately to the one or other broad side of the track 50 (when the relevant yarn guides 19 pass through the working section 51) and cannot come into contact with the track 50. By incorporating additional guide rails, one can ensure that the rocking levers 80 then remain in the desired pivot position and when passing the deflection wheel 55, are tilted back to the vertical position. In the same way as the yarns 16, the rocking levers 80 also pass into the radial slots 77 when passing the deflection wheels 54, 55.

Instead of rocking levers 80 with eyelets 82, it is possible to use rocking levers 83 in the form of tubes. An advantage of these tubes is that the yarns are completely protected from contact with sections of the deflector wheels 54 and 55 when passing these.

The track 50 is particularly space-saving, since it is single-track and its symmetrical plane can be arranged in the same plane as the working region of the laying-in elements 21 and the eyelets 15.

Figure 4:
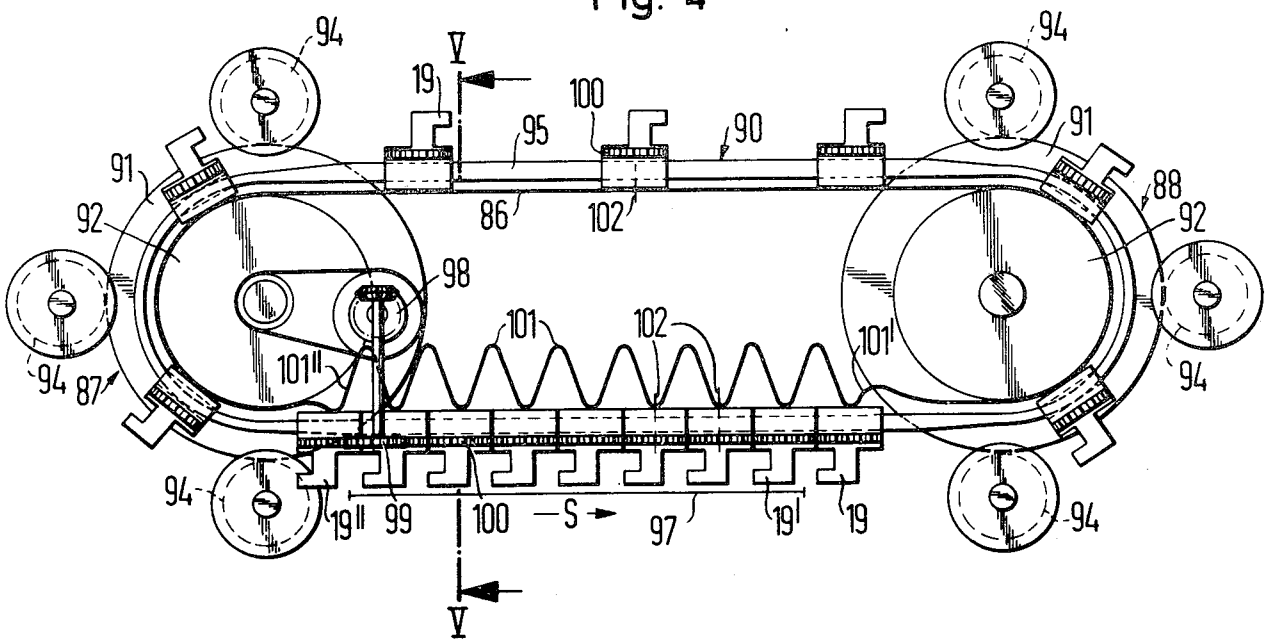
FIG. 4 shows a schematic side view of a second embodiment of the invention.
Figure 5:
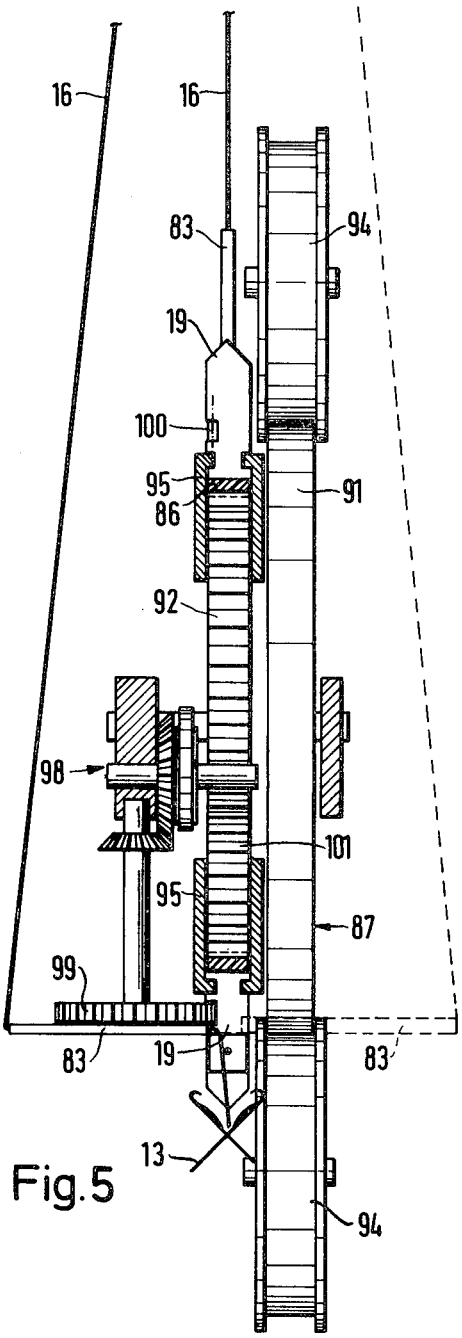
FIG. 5 is a section along the line V—V of FIG. 4.

FIGS. 4 and 5 show schematically, how with the embodiment according to FIG. 1, the number of yarn guides can be reduced by simple means from twenty-three to sixteen without altering the number of yarn guides participating simultaneously in the knitting process. Instead of the belt 53, the yarn guides 19 are driven by a belt 86, the length of which is considerably greater than the length of a deflected track 90, predetermined by two deflector rolls 87 and 88. The deflector wheels 87 and 88 are rotatably mounted according to the embodiment as per FIG. 1 in a rigid rail (not illustrated), but in contrast to FIG. 1, they consist of only one circular disc 91 each, with comparatively large diameter and a drive wheel of comparatively smaller diameter 92 on which the belt 86 runs. The two circular discs 91 are each suspension mounted in a support system, which in this case, consists of three support rolls 94, which rotate about the circumference of the circular discs 91 and also serve to drive same, in that at least one suport roll 94 is connected with a drive mechanism. The rotary track 90 is formed by at least one O-shaped guide rail 95, which is attached to the rigid rail connecting the two deflection wheels 87 and 88, and guides the yarn guides 19 along a track, incorporating a working section, a return section and two sections connecting these, such that the working section is arranged above the working range of the laying-in elements, indicated in FIG. 4 by the line 97.

The shaft of the deflector wheel 87 is coupled to a reduction gear 98, on the drive shaft of which is a pinion 99, which engages in the teeth 100 on the outside of the yarn guide 19 and can drive the latter at a slower speed in the direction of the arrow S, than the speed of the belt 86. As shown in FIG. 4, the yarn guides 17, as long as they are in the working section, can be arranged without interval, side by side, so that the flexible belt 86 is undulated in this region, the size of the undulations 101 depending on the belt length between the securing points 102 of the belt 86 to the yarn guides 19. The arrangement is such that at the outgoing side of the working section, the belt section which is accumulated in that undulation 101' which is formed between the last yarn guide 19' still in the working section, and the preceding yarn guide no longer in the working section, is only completely utilised by the tension of the preceding yarn guide already being transported with the high speed of the belt 86 and after which, the yarn guide 19' has also left the working section. Accordingly, the arrangement at the ingoing side to the working section is such that the first yarn guide 19'', transported at the speed of the belt 86, runs on to the preceding yarn guide, which is driven by the pinion 99 and already in the working section, so as to form an undulation 101'', before it enters the working section itself and is driven by the pinion 99. This arrangement ensures that the yarn guides 19 in the working section, are transported at a comparatively slow speed corresponding to the knitting speed, and hence the smallest possible spacing exists, whereas the yarn guides outside the working section are returned to the start of the working section at relatively high speed.

Figure 6:
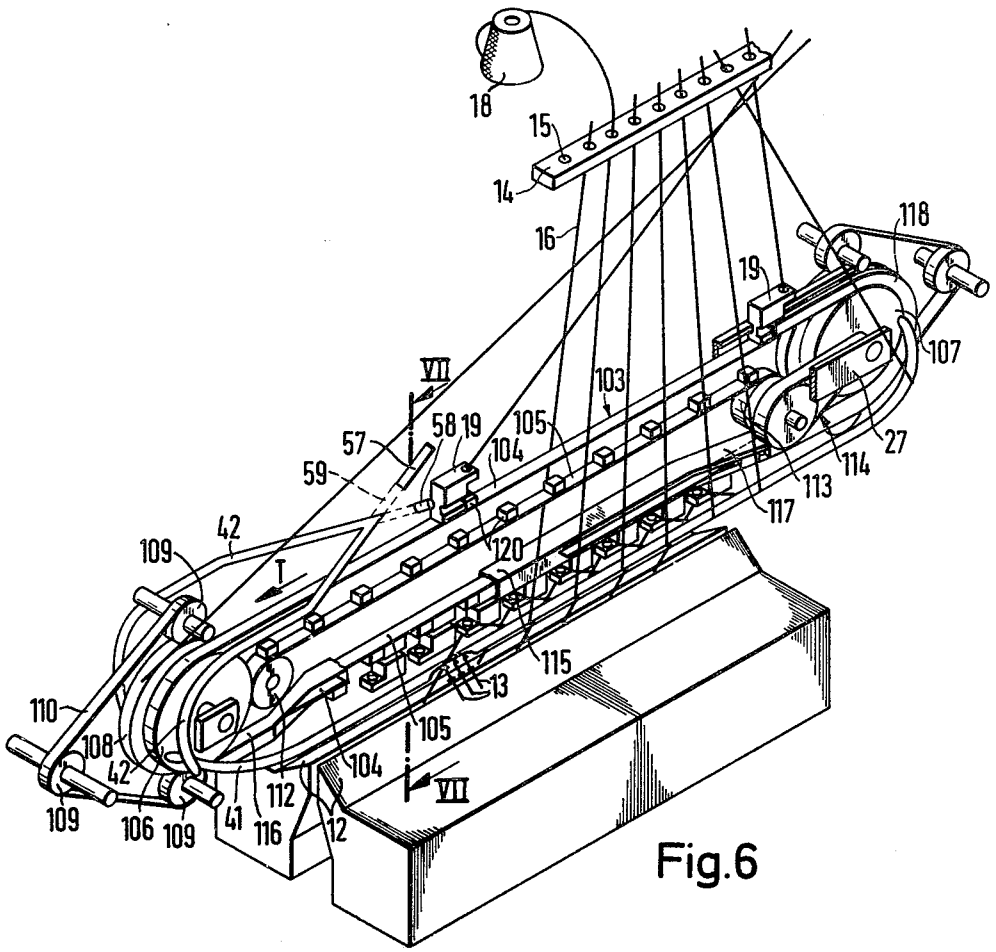
FIG. 6 is a schematic perspective diagram of a third embodiment of the invention.
Figure 7:
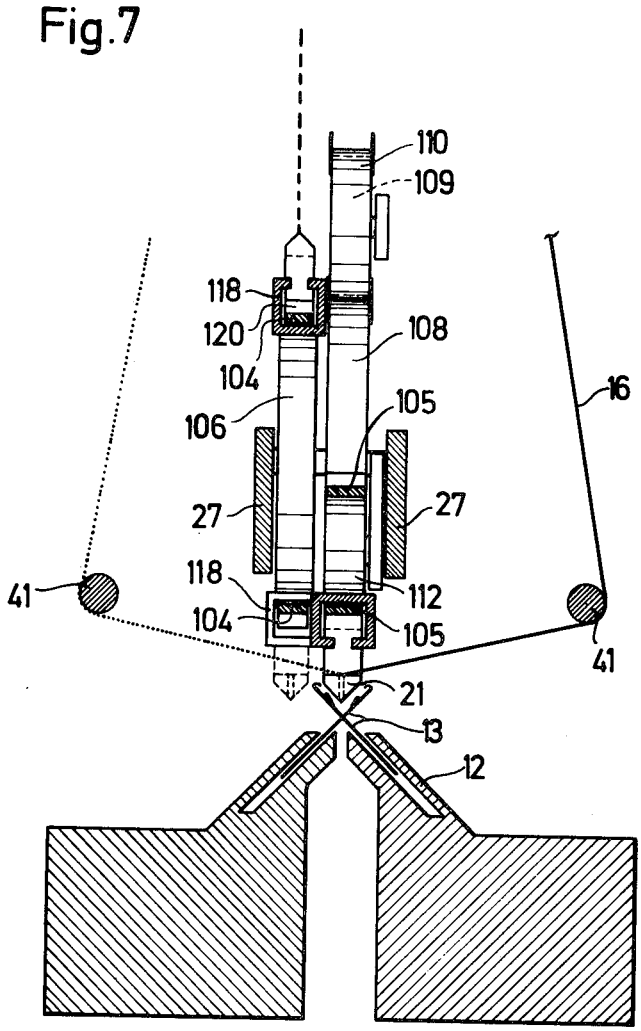
FIG. 7 is a section along the line VII—VII of FIG. 6.

In the embodiment according to FIGS. 6 and 7, the rapid return of the yarn guides 19 is brought about in that two belts 104 and 105 are provided instead of only one 53 (FIG. 1) to drive the yarn guides 19 on an endless, single-track 103, and that the lower runs of these belts 104 and 105 are parallel and arranged side by side, such that the lower run of the belt 105 lies above the working range for the laying-in elements. The belt 104 is carried by two drive wheels 106 and 107, each of which is fitted with a wheel 108, having radial slots, according to FIG. 1. The wheel 108 is float-mounted in a support system consisting of support rolls 109 and a support belt 110. One of the support rolls 104 is connected with a drive mechanism (not illustrated), so that the support belt 110 also serves as the drive for the wheel 108 or the drive wheel 106 and the belt 104. The common shafts for the wheel and drive wheels are mounted in the rigid rail 27, in which two deflector wheels 112 and 113 are also mounted so as to rotate, and about which the belt 105 is laid. The shaft of the deflector wheel 113 is coupled via a transmission gear 114 so as to be driven with the axis of the drive wheel 107, so that the belt 105 is driven at a slower speed than the belt 104.

The rotary track 103 is made up of tubular guide rails, shown only partially in FIG. 6 for the sake of simplicity. These guide rails extend along a straight, lower working section 115 (FIG. 6) which is located above the working range for the laying-in elements, and takes up the lower run of the belt 105. The two ends of the working section 115 are adjoined by S-shape sections 116 and 117, the other ends of which are connected by a return section 118, which is curved in the region of the drive wheels 106 and 107 and which is straight in the upper section. This return section 118 takes up the belt 104. On their outer surfaces, the belts 104 and 105 have pawls 120 which lie against the sections of the yarn guides 19, which glide in the tubular guide rails, and thus entrain the yarn guides 19. The S-shaped sections 116 and 117 thus represent transfer points to push the yarn guides 19 from the belt 104 to the belt 105 and vice versa.

The mode of operation of the embodiment according to FIGS. 6 and 7 is characterised, as with the embodiment according to FIG. 1, essentially in that the yarn sections, located between the yarn guides 19 and the eyelets 15, are deflected alternately by the shunt 59 to the one or other side of the rotary track. When moving in the direction of the arrow T, when a yarn guide 19 reaches the section 116, then it is pushed by this, at right angles to the transport direction, from the belt 104 to the belt 105, and then moved at relatively slow speed through the working section 115. At the end of the working section, this yarn guide moves into the section 117 and is pushed from here by the belt 105 back to the belt 104, so that it is returned at higher speed to the start of the working section.

Figure 8:
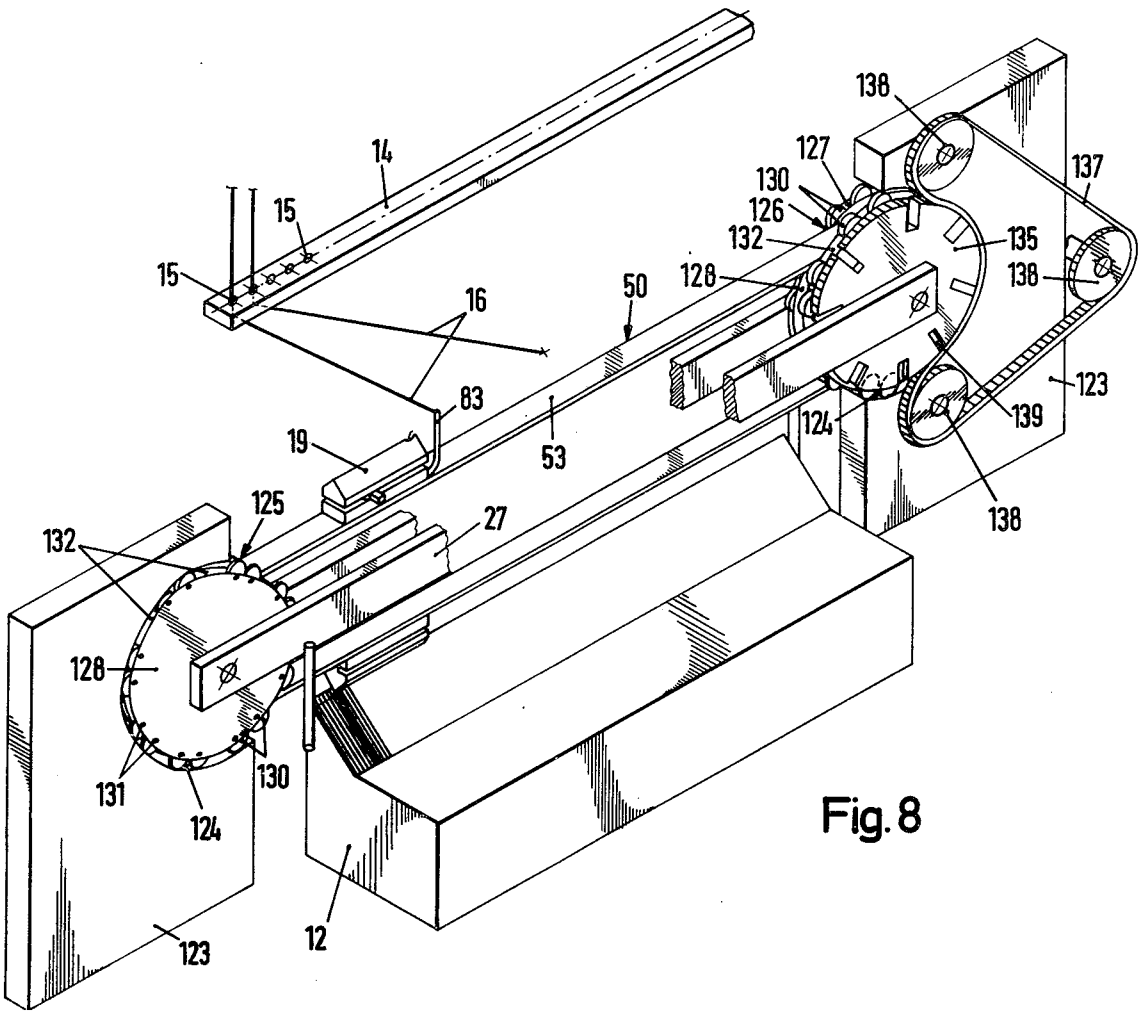
FIGS. 8 and 9 are schematic, perspective diagrams of a fourth and fifth embodiment of the invention.

Since the embodiment according to FIG. 8 differs from the embodiment according to FIG. 1 simply by a different support system for the floating bearing of the rotary track 50, all the unessential details have been omitted in FIG. 8. Every support system has a stationary bearing journal 123, each with a recess 124 for the floating bearing of a deflector wheel 125 and 126. These deflection wheels 125 and 126 differ from the corresponding deflection wheels 54 and 55 of FIGS. 1 and 2, in that they each have one circular disc 127 and 128, in the peripheral surfaces of which, peripheral grooves are provided to accommodate the idler rolls 130, the shafts 131 of which are rotatably mounted in the outer rims of the circular discs 127 and 128, and roll on the bearing surfaces, formed by the recesses 124 of the bearing bushes 123, the contour of said bearing surfaces corresponding exactly to the enveloping circle formed by the contact points of the idler rolls 130. Instead of the slots 78 (FIG. 1), provision is made at the positions corresponding to the slots 78, for adequate interspaces 132, to accommodate the yarns 16 or the rocking lever 83. The interspaces 132 are obtained for example, in that at the said positions, one idler roll 130 is omitted from each. Hence with this embodiment also, the yarn path is not hampered by the floating support given to the rotary track 50.

For driving the deflection wheels 125 and 126 and/or the belt 53, a drive sprocket 135 is attached to the shaft of the deflector wheel 126, said drive sprocket 135 engaging with a toothed belt 137 with a portion of its circumference, the toothed belt 137 being guided by guide rolls 138, one of which is connected with a drive means. Similar to the flanged discs 77, according to FIG. 1, radial slots 139 are provided in the drive sprocket 135, the slots 139 being arranged at the positions corresponding to the interspaces 132 and thus allow for unhampered passage of the yarns 16 and/or the rocking lever 83.

Figure 9:
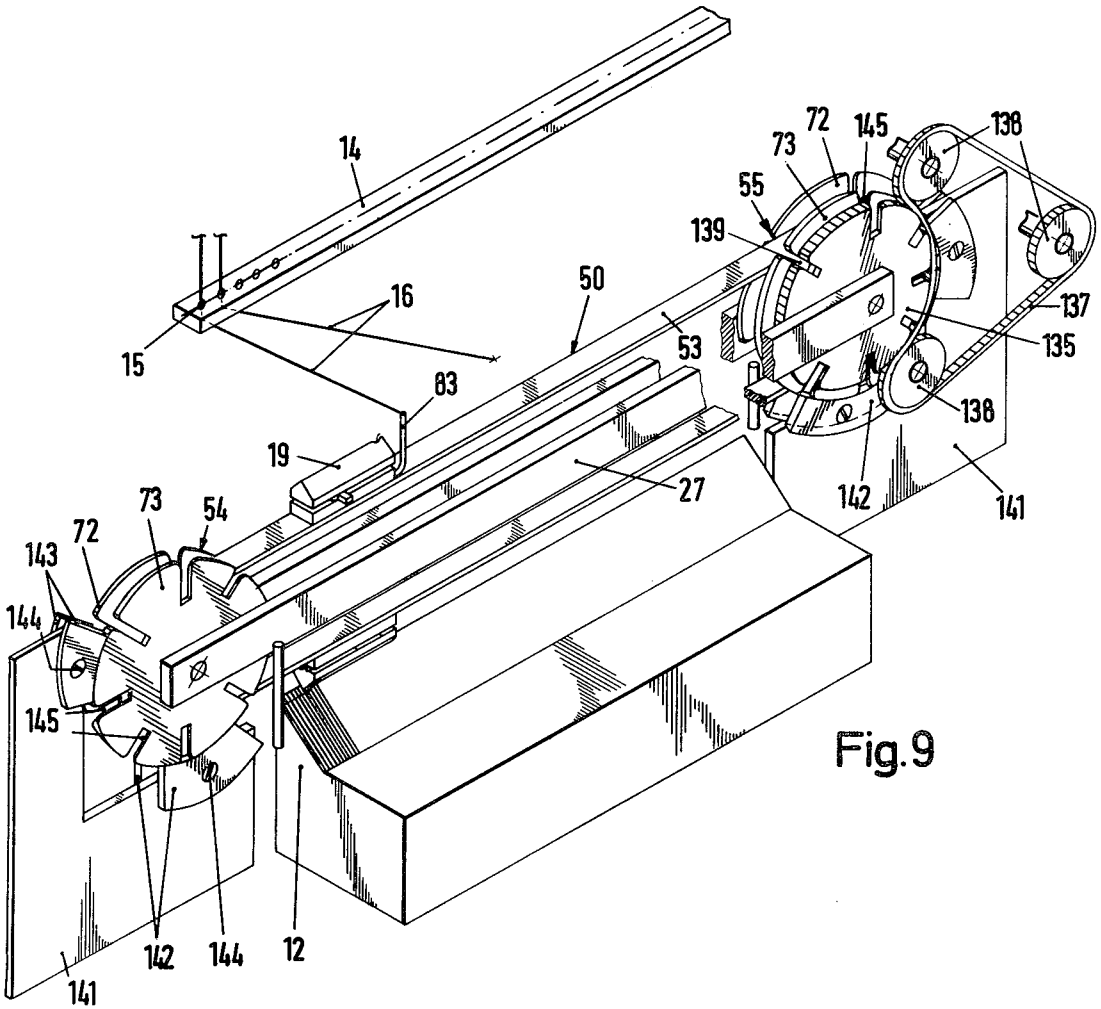

The embodiment according to FIG. 9 differs from the embodiment shown in FIG. 1 again only by the different support system for the suspension design of the deflection wheels 54 and 55. Each support system includes a support 141, to which, on at least two positions, two sliding cheeks 142 and 143 are fitted, the bearing surface of which have a profile matching exactly the outer profile of the circular discs 72 and 73 of the deflection wheels 54 and 55. In order that the sliding cheeks 142 and 143 automatically lie correctly against the peripheral surface of the circular discs 72 and 73, the sliding cheeks 142, 143 are pivotly mounted by means of screw bolts 144. The circular discs 72, 73 have slots 145 for accommodating the yarns 16 and/or the rocking lever 83.

The sliding cheeks 142, 143 are preferably of a self-lubricating material, e.g. Carobronze, (supplied by Messrs Carobronze GmbH, Berlin). Since, because of the wear on the self-lubricating material, especially the gaps between the two upper sliding cheeks 143 and the circular discs 72, 73 become increasingly larger, these sliding cheeks 144 are preferably adjustable and pre-tensioned, e.g. by springs acting in the direction of the circular discs 72 and 73.

The length of the sliding cheeks 142 and 143 in the peripheral direction of the circular discs 72 and 73 is preferably larger than the distance between two slots 145, thereby providing for very smooth running.

Figure 10:
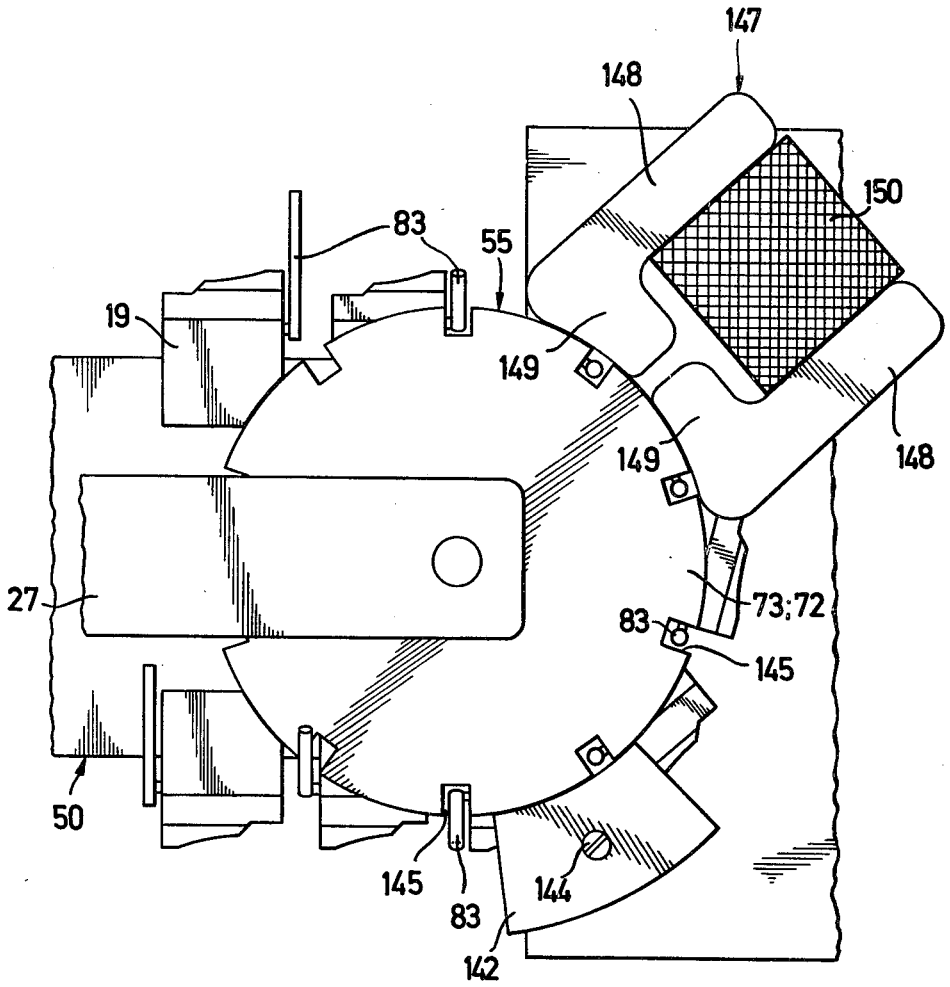
FIG. 10 is a schematic front view of a sixth embodiment of the invention.

A further development of the embodiment according to FIG. 9 is shown in FIG. 10, in that the upper sliding cheeks are in the form of magnetic bearings 147. The magnetic bearings 147 could be two pole pieces 148, the ends of which serve as sliding cheeks 149 for the circular discs 72 and 73 and between which a permanent or electromagnet 150 is fitted. The magnetic bearings 147 serve to relieve the lower sliding cheeks 142, which support the whole weight of the rotary track 50, and attract the ferromagnetic material circular discs 72 and 73 so strongly that the sliding cheeks 149 are stressed to roughly the same degree as the sliding cheeks 142.

Apart from the described passive magnetic bearing, an active magnetic bearing may also be provided (cf. for example, SKF-Technical Information Sheet No. 299 dated 12.4.1977). Such a magnetic bearing is characterised in that the circular discs 72 and 73 to be supported, are held firmly at a specific distance from the bearing surfaces by means of controlled electromagnetic attraction forces. By means of sensors (not illustrated) the positions of the circular discs 72 and 73 are thus constantly supervised and the measured signals are processed in an appropriate switchgear, which controls amplifiers, which in turn generate such currents in the windings of the electromagnets 150, that the resulting magnetic attraction forces hold the circular discs 72 and 73, firmly in the desired position. Amongst other things, this affords the advantage of a fully contactless and non-lubricating system.

The invention is not confined to the embodiment examples described above, but can be modified in many ways. This applies particularly to the yarn feeders and guides, to the yarn clamps provided therein, to the cutting devices which are necessary for cutting the yarns at the end of the working sector and how the yarn clamps (nippers) are known fundamentally from the cited Dt. OLS Nos. 20 64 227, 23 51 741, 25 31 762 and 24 50 020 as well as from Dt. AS Nos.23 32 440, and to the means for deflecting the yarn feeders/guides, yarns and rocking levers. Moreover, the systems and bearings described in conjunction with FIGS. 1 to 10, may be combined in a variety of ways and means.

Moreover, the invention is not confined specifically to slots in the circular discs and/or flanged discs to run parallel to the axes of the circular discs. The slots in the circular discs, especially when provided to act as bearings for support rolls, as in FIGS. 4 and 5, are preferably arranged at an angle to the axes of the circular discs, such that the slots are always covered by the support rolls when one support roll runs over a region of a circular disc with a slot, thereby providing for smooth and uniform rolling of the support rolls on the circular discs. For the same purpose, in cases where each deflector wheel has two parallel circular discs, either both circular discs or both support rolls may be staggered relative to each other in tangential direction, such that only one support roll is always in the region of a slot.

Furthermore, the invention is not limited to the described means for preventing entwining of the yarns. It is not necessary for example, to allow the yarn guides and the yarn feeders on the same rotary track. The yarn guides and the laying-in elements in fact form two systems, which are interdependent only in as much as the yarn guides have the task, either on their own or in conjunction with other means, to prevent entwining of the yarns, whereas the laying-in elements serve the purpose of presenting the yarns to the provided elements of the machine whenever the yarn guides are in the working section of their rotary track.

It is also possible therefore, to arrange for the laying-in elements and the yarn guides to run around separate tracks such that the laying-in elements always pick up the yarn only just before entry into the working section and release the yarn again after passing the working section. Moreover, these rotary tracks may be mounted on the bearing systems described.

Finally, instead of the active magnetic bearing, based on the attraction forces described in conjunction with FIG. 10, it is possible to use magnetic bearings based on corresponding electromagnetic repulsion forces. In both cases, it is advisable not only to design the upper sliding cheek, as in FIG. 10 as the active magnetic bearing, but also the lower sliding cheek, as in FIG. 10, so that in this case, both sliding cheeks together form the active magnetic bearing.

We claim:

1. Apparatus for textile machines for feeding yarn, sliver or fibrous materials, wound on to fixed supply packages, with at least one endless track, having a working section and a return section, the said track having movable material transporting elements arranged on it to run around in series wherein the track is a single-path, O-shaped, floating-mounted track (50, 90, 103) and the materials (16) are fed to the movable elements (19) during their successive runs through the working section (51, 115) alternately from the one and the other side of a surface, laid through the working section (51, 115) and the return section (52, 118) of the track (50, 90, 103).

2. Apparatus according to claim 1, wherein the track (50) has a linear working section (51) and a linear return section (52) and two further sections connecting these two and similarly serving as a return.

3. Apparatus according to claim 2, wherein all sections lie in essentially the same plane.

4. Apparatus according to claim 2, wherein the return section (52) is arranged parallel to the working section (51).

5. Apparatus according to claim 2, wherein the track (50, 90, 103) is defined by two wheels (54, 55; 87, 88; 106, 107; 125, 126) the axes of which are mounted on the ends of at least one rigid rail (27).

6. Apparatus according to claim 5, having a support frame for the floating mounting of each wheel (54, 55; 87, 88; 106, 107; 125, 126).

7. Apparatus according to claim 6, wherein each wheel (54, 55; 87, 88; 106, 107; 125, 126) comprises at least one circular disc (72, 73; 91; 108; 127, 128) which is engaged by the support frame and to which is attached a coaxial drive wheel (74; 92; 106) for the movable elements (19).

8. Apparatus according to claim 6, wherein each wheel (54, 55; 125, 126) is made up of two circular discs (72, 73; 127, 128), which are engaged by the support frame, and between which is secured a coaxial drive wheel (74) for the movable elements (19), such that the outside diameter of the drive wheel (74) is smaller than the outside diameter of the circular discs such that between the peripheral lines of the circular discs and the drive wheel, sufficient space is left to accommodate the running movable elements (19).

9. Apparatus according to claim 7, wherein at the outsides of the circular discs (54, 55), coaxial flanged coupling pulleys (77) are fitted, the diameter of which is larger than the diameter of the circular discs (54, 55).

10. Apparatus according to claim 9, wherein at the perimter of the flanged pulleys (77), radial slots (78) are provided to receive deflector elements (83) for the materials (16) and/or the materials (16) during those intervals of time during which the guide elements (19) pass the wheels (54, 55).

11. Apparatus according to claim 8, wherein at the perimeter of the circular discs, provision is made for radial slots (145) to receive deflector elements (83) for the materials and/or the materials (16) during those periods of time when the guide elements (19) pass the wheels (54, 55).

12. Apparatus according to claim 10, wherein the slots run parallel to their axes.

13. Apparatus according to claim 6, wherein each support frame consists of at least two support rolls (94).

14. Apparatus according to claim 13, wherein the two circular discs (72, 73) are staggered mutually and tangentially such that always only one support roll is in the vicinity of the slot.

15. Apparatus according to claim 13, wherein the support rolls (94) are mutually staggered in tangential direction such that always only one support roll (94) is in the region of a slot (78).

16. Apparatus according to claim 13, wherein the slots in the circular discs form such an angle with their axes, so that when one support roll (94) rolls over the region of a circular disc (91), provided with a slot, the slots are always covered by the support roll.

17. Apparatus according to claim 6, wherein each support system comprises at least two support rolls (63 to 66, 109) and a support apron (110) wrapped around said rolls and carrying one of said wheels.

18. Apparatus according to claim 17, wherein at least one support roll (63) is connected with a drive means (69, 70).

19. Apparatus according to claim 17, wherein the support apron (67) consists of a toothed belt, being toothed both on the inside and outside and the support rolls (63 to 66) and the circular discs (72, 73) being toothed correspondingly.

20. Apparatus according to claim 6, wherein each support system includes a bearing shell (123) to support a wheel (125, 126) and that at the perimeter of each wheel (125, 126) a number of bearing rollers (130) are mounted rotatably.

21. Apparatus according to claim 20, wherein the bearing rollers (130) are mounted in the circular discs (127, 128).

22. Apparatus according to claim 7, wherein each support system has at least two sliding surfaces (142, 143; 149) to support the circular discs (72, 73).

23. Apparatus according to claim 22, wherein the length of the sliding surfaces (142, 143; 149) in the peripheral direction is greater than the distance between the slots (145) in the circular discs (72, 73).

24. Apparatus according to claim 22, wherein the sliding surfaces (142, 143) are pivotly mounted on studs (144) arranged parallel to the axes of the circular discs.

25. Apparatus according to claim 22, wherein the sliding surfaces (142, 143) are made at least partially, of self-lubricating material.

26. Apparatus according to claim 25, wherein at least one sliding surface (143) is mobile.

27. Apparatus according to claim 25, wherein at least one sliding surface (143) is spring loaded in the direction of the circular discs (72, 73).

28. Apparatus according to claim 22, wherein a first sliding surface (142) is arranged essentially vertical beneath the shaft of the circular disc (72, 73) to be supported, and a second sliding surface (143, 149) is arranged essentially above this shaft.

29. Apparatus according to claim 28, wherein the second sliding surface (149) comprises a passive magnetic bearing.

30. Apparatus according to claim 28, wherein the second sliding surface comprises an active magnetic bearing.

31. Apparatus according to claim 22, wherein at least two sliding surfaces of every support system form an active magnetic bearing.

32. Apparatus according to claim 7, wherein to drive the movable elements (19) on the rotary track (50, 90, 103), provision is made for at least one endless, flexible belt (53, 86, 104), supported by the drive wheels (74, 92, 106).

* * * * *